United States Patent [19]

Romanski et al.

[11] 4,006,760

[45] Feb. 8, 1977

[54] FABRIC CONNECTOR SEAM

[75] Inventors: Eric R. Romanski, Delmar; Orrin C. Stevens, Greenville, both of N.Y.

[73] Assignee: Albany International Corporation, Albany, N.Y.

[22] Filed: Jan. 8, 1976

[21] Appl. No.: 647,616

[52] U.S. Cl. ..... 139/383 A; 28/72 R; 245/10; 162/DIG. 1

[51] Int. Cl.[2] ..... D03D 25/00; D21F 7/10; D21F 1/12

[58] Field of Search ..... 139/383 A, 383 R, 384 R, 139/408, 409, 425 A; 28/72 R; 245/10; 162/DIG. 1, 348, 358

[56] References Cited

UNITED STATES PATENTS

| | | | |
|---|---|---|---|
| 2,101,359 | 12/1937 | Bonner | 139/383 R |
| 2,672,168 | 3/1954 | Walters | 139/383 R |
| 2,907,093 | 10/1959 | Draper, Jr. | 139/383 A |
| 3,225,900 | 12/1965 | MacBean | 139/383 A |
| 3,283,388 | 11/1966 | Kelleher et al. | 28/72 R |
| 3,478,991 | 11/1969 | Schiel et al. | 245/10 |

FOREIGN PATENTS OR APPLICATIONS

| | | | |
|---|---|---|---|
| 325,773 | 7/1970 | Sweden | 139/383 A |
| 982,682 | 2/1965 | United Kingdom | 139/383 A |
| 1,072,317 | 6/1967 | United Kingdom | 139/383 A |

OTHER PUBLICATIONS

*Modern Textile Magazine*, 1975 Man–Made Fiber Desk Book, Mar. 1975, pp. 17 and 28 relied on.

*Primary Examiner*—James Kee Chi

[57] ABSTRACT

A fabric connector seam in which woven complementary seam-halves joined by a pintle are provided and in which each seam-half comprises a single and a double layer zone mechanically bound by the nature of the weave and in which the crosswise yarns of each seam-half form alternately displaced loops on one edge thereof which can be intermeshed with like loops formed on the edge of the remaining seam-half.

7 Claims, 5 Drawing Figures

FIG. 1
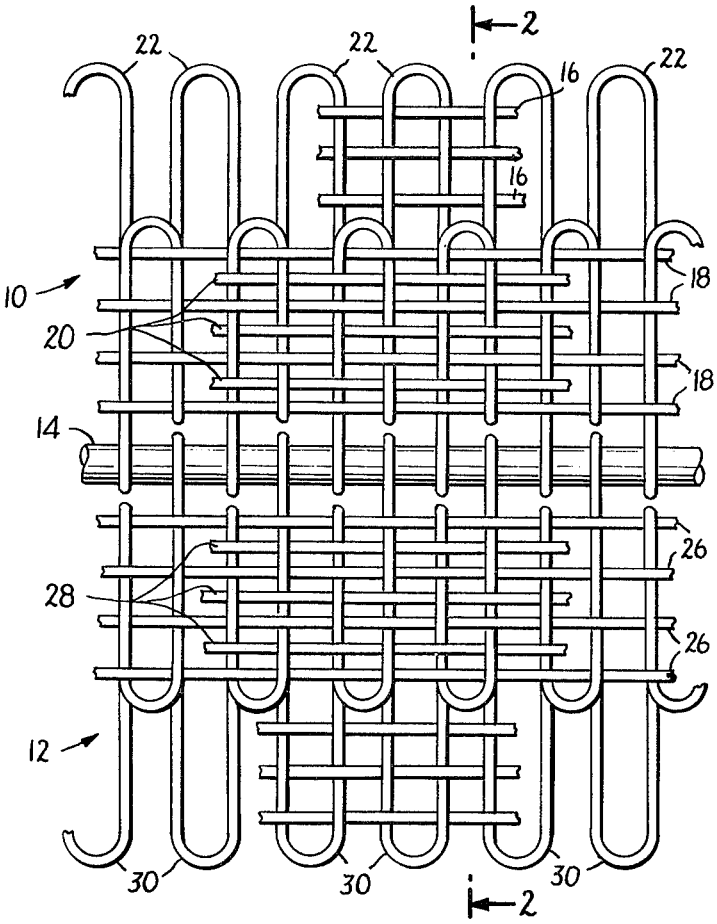
FIG. 2
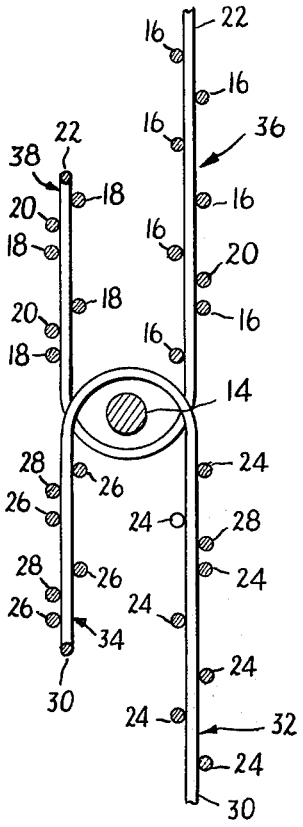
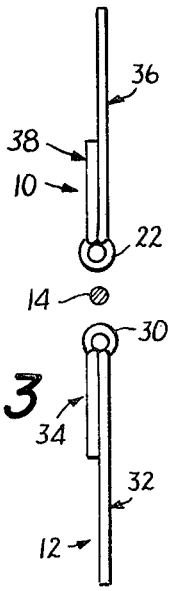
FIG. 3
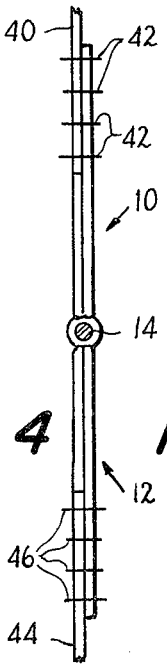
FIG. 4
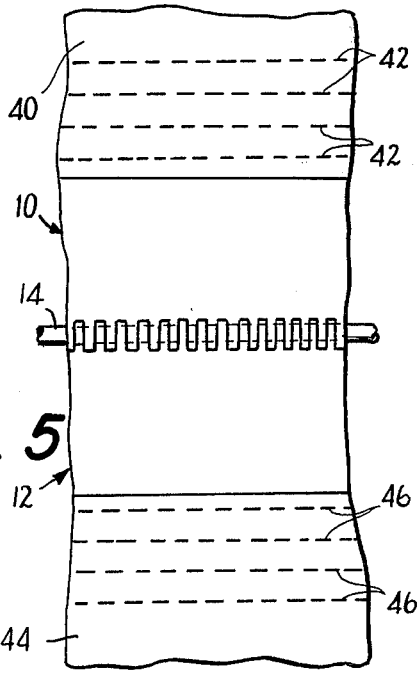
FIG. 5

FABRIC CONNECTOR SEAM

BACKGROUND OF THE INVENTION

Fabrics used as forming fabrics, dryer felts, conveyor belts on pulp filtration drums, and industrial fabrics in general are of a great variety, examples of which are the typically woven fabrics and the needled fabrics having a woven base. Additionally, there are certain fabrics which are needled without a woven base and others of differing construction but of nonwoven form. These fabrics are generally used in the form of a conveyor or endless belt. The fabric therefore must be of endless configuration. Some fabrics are actually constructed endless, for example, by weaving in tubular form, whereas others are constructed in rectangular form and their free ends joined together to form the endless belt or tube. It is to this latter type of fabric that this invention is directed.

Various methods of joining fabric ends to form an endless belt have been utilized through the years in the industrial fabric industry. In recent years, however, the treating of fabrics and the materials available from which fabrics are formed, such as the synthetic materials, have resulted in fabrics which are very strong and durable and which have many improved characteristics in comparison to such as were used in the recent past. The machines upon which these fabrics are run today are operated at much higher speeds than heretofore, thereby requiring that they be of great durability.

Through the application of the new synthetic materials and through the utilization of various treatments and finishing procedures the fabrics used today can be operated and used over longer periods than previously even though in today's machinery they are subjected to processes which have a greater tendency to deteriorate and damage the fabrics.

The traditional method for making fabrics such as papermaker dryer felts endless is the insertion of metal hooks in the ends to be joined. The procedure involves a machine that forces the points of the metal hooks into the fabric or into a webbing that is later sewn to the fabric. These hooks are inserted across the width of the fabric. This requires special equipment and the time needed is quite extensive. The resulting metal seam is inflexible and subject to abrasion. If tension during use of the fabric exceeds the crimp force the metal hook can be pulled from the fabric.

The art has reached a degree of development such that the seams or joining areas of the fabrics whereat ends are joined to make them endless has become a weak part in the fabric. Improvements of fabrics through the use of chemical treatments and synthetic materials to increase life are of no use if the seams are not durable and able to withstand deteriorating forces. It is also not useful to have seams at seam areas which must be strengthened and treated so that the characteristics in these zones are totally different than the characteristics of the remaining portion of the fabric.

SUMMARY OF THE INVENTION

It is principal object of this invention to provide a fabric connector seam which is strong and durable, and one which can be woven on a loom and removed from the loom, requiring no additional work other than attaching it to the fabric that is to be joined.

Such a seam is provided having two identical seam-halves joined by a pintle in which each seam-half contains first, second and third warp systems and a single filling system, the first and second warp systems respectively providing with the filling, face and back weaves, the face weave overlying the back weave for a portion thereof providing a double layer zone and the third warp system binding the face and back weaves together in the double layer zone, and the filling system woven in the folded position along an edge to enable said face weave to overly said back weave and to form alternately displaced protruding loops along said edge for intermeshing with like loops formed along the edge of a like seam-half for receipt of said pintle.

BRIEF DESCRIPTION OF THE DRAWINGS

FIG. 1 is a segmentary plan view of a seam constructed in accordance with this invention;

FIG. 2 is a sectional view taken along the line 2—2 in the direction of the arrows in FIG. 1;

FIG. 3 is a side schematic view of two seam-halves unjoined;

FIG. 4 is a view similar to that of FIG. 3 in which the seam-halves are joined by a pintle; and FIG. 5 is a plan view of the seam shown in FIG. 4.

DESCRIPTION OF THE PREFERRED EMBODIMENT

The invention disclosed herein is illustrated in the FIGS. where the numerals 10 and 12 indicate identical seam-halves joined by pintle 14. Each of the halves 10 and 12 contains first, second and third warp systems and a single filling system. Hence in the FIGS. the first, second and third warp systems of seam-half 10 are respectively indicated by the numerals 16, 18 and 20 and the filling by the numeral 22 while in seam-half 12 these are respectively indicated by the numerals 24, 26, 28 and 30.

The first and second warp systems in each seam-half provides with the filling of that seam-half, back and face weaves. In the Figs, in seam-half 12 the warp systems 24 and 26 provide with the filling 30, back weave 32 and face weave 34 with the face weave overlying the back weave for a portion thereof and with the third warp system 28 binding face and back 34 and 32 together in the zone of overlying.

The seam-half 10 is similarly constructed with warp systems 16 and 18 providing with filling 22 back and face weaves 36 and 38 overlying for a portion and the third warp system 20 binding these together in the zone of overlying to provide a double layer. In each seam-half the zone where the face and the back weave overly is a double layer zone and the face and back weave are maintained in position in this zone by the third warp system. The filling system during weaving is formed over an edge cord, not shown, to provide the stepped configuration with protruding loops along the double layer edge where the filling system is folded. The loops so formed are vertical to the plane of the seam-half or webb through which the pintle can be inserted. This provides a means to mesh opposing loops, and provides a positive lock upon joining pin insertion to make the fabric endless. During weaving of the seam-half heat can be applied to heat set the filling loops as they are formed over the edge cord.

The structure of the webb or seam-half can be of yarns made from NOMEX, nylon or polyester. The filling yarn in the preferred embodiment is a four-carrier braid with a core yarn to add strength and prevent elongation. The double layer area of the webb is a double plain weave bound together by the third warp system, all of which are integrally woven together with the single layer side of the webb. All edges are woven in and cannot unravel.

The loom used to weave the seam-half is a conventional narrow fabric webbing loom as known in the narrow fabric industry. The edge cord diameter can be varied to vary the loop diameter if desired. A chemical treatment can be applied, if desired, to the filling yarn before, during or after weaving in order to lend stiffness and physical integrity to the loops.

The attachment of the seam-half to a fabric or belt such as a papermaker dryer felt is accomplished as shown in FIGS. 4 and 5 by butting the fabric ends to the stepped area and sewing the single layer area to the fabric ends. In the FIGS. seam-half 10 is attached to felt end 40 by stitching 42 and seam-half 12 is attached to felt end 44 by stitching 46.

We claim:

1. A fabric connector seam having two identical seam-halves joined by a pintle in which each seam-half contains first, second and third warp systems and a single filling system, said first and second warp systems respectively providing with said filling, face and back weaves, said face weave overlying said back weave for a portion thereof providing a double layer zone and said third warp system binding said face and back weaves together in the double layer zone, and said filling system woven in folded position along an edge to enable said face weave to overly said back weave to form alternately displaced protruding loops along said edge for intermeshing with like loops formed along the edge of a like seam-half for receipt of said pintle.

2. A fabric connector seam-half containing first, second and third warp systems and a single filling system, said first and second warp systems respectively providing with said filling, face and back weaves, said face weave overlying said back weave for a portion thereof providing a double layer zone and said third warp system binding said face and back weaves together in the double layer zone, and said filling system woven in folded position along an edge to enable said face weave to overly said back weave to form alternately displaced protruding loops along said edge.

3. A fabric connector seam-half in accordance with claim 2 in which said filling loops are formed of a heat settable material and are heat set into position.

4. A fabric connector seam-half in accordance with claim 2 in which the filling yarn is a four-carrier braid having a core yarn.

5. A fabric connector seam-half in accordance with claim 4 in which the filling yarn is multifilament NOMEX.

6. A fabric connector seam-half in accordance with claim 2 in which the double layer is a double plain weave bound together by the third warp system.

7. A fabric connector seam-half in accordance with claim 2 in which the seam-half is of stepped configuration so that it can be attached to a fabric by stitching the single layer thereto.

* * * * *